US005971450A

United States Patent [19]

Suarez

[11] Patent Number: 5,971,450

[45] Date of Patent: Oct. 26, 1999

[54] ADJUSTABLE TELESCOPIC WINDOW SECURITY SYSTEM

[76] Inventor: Alfred Suarez, 3286 Woody La., San Jose, Calif. 95132

[21] Appl. No.: 08/664,555

[22] Filed: Jun. 14, 1996

[51] Int. Cl.[6] ..... E05C 19/18

[52] U.S. Cl. ..... 292/289; 292/DIG. 28; 292/DIG. 46

[58] Field of Search ..... 292/288, 289, 292/339, DIG. 28, DIG. 46

[56] References Cited

U.S. PATENT DOCUMENTS

| | | | |
|---|---|---|---|
| 2,315,566 | 4/1943 | Watral et al. | 292/DIG. 28 X |
| 2,812,095 | 11/1957 | Sutherland | 292/339 X |
| 3,059,952 | 10/1962 | Wittman et al. | 292/288 |
| 4,846,513 | 7/1989 | Mathis, II | 292/288 X |
| 5,102,173 | 4/1992 | Schallern | 292/288 |
| 5,265,921 | 11/1993 | Nikitas et al. | 292/DIG. 28 X |

FOREIGN PATENT DOCUMENTS

| | | | |
|---|---|---|---|
| 4237061 | 1/1994 | Germany | 292/289 |

*Primary Examiner*—Rodney M. Lindsey

[57] ABSTRACT

A new Adjustable Telescopic Window Security System for facilitating increased security for various sizes of conventional windows while allowing the user to simultaneously adjust the position of the window so as to allow ventilation through the conventional window. The inventive device includes a telescopic security tube adjustable to various sizes of windows, at least one window engaging suction cup to retain the present invention to the conventional window, and a pair a pane engaging caps secured to opposite ends of the telescopic security tube engaging the conventional window pane.

10 Claims, 3 Drawing Sheets

ADJUSTABLE TELESCOPIC WINDOW SECURITY SYSTEM

BACKGROUND OF THE INVENTION

1. Field of the Invention

The present invention relates to Security Devices and more particularly pertains to a new Adjustable Telescopic Window Security System for facilitating increased security for various sizes of conventional windows while allowing the user to simultaneously adjust the position of the window so as to allow ventilation through the conventional window.

2. Description of the Prior Art

The use of Security Devices is known in the prior art. More specifically, Security Devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art Security Devices include U.S. Pat. No. 4,493,501; U.S. Pat. No. 4,596,484; U.S. Design Pat. No. 348,706; U.S. Pat. No. 5,296,096; U.S. Pat. No. 4,413,852 and U.S. Pat. No. 4,679,351.

While these devices fulfill their respective, particular objectives and requirements, the aforementioned patents do not disclose a new Adjustable Telescopic Window Security System. The inventive device includes a telescopic security tube adjustable to various sizes of windows, at least one window engaging suction cup to retain the present invention to the conventional window, and a pair a pane engaging caps secured to opposite ends of the telescopic security tube engaging the conventional window pane.

In these respects, the Adjustable Telescopic Window Security System according to the present invention substantially departs from the conventional concepts and designs of the prior art, and in so doing provides an apparatus primarily developed for the purpose of facilitating increased security for various sizes of conventional windows while allowing the user to simultaneously adjust the position of the window so as to allow ventilation through the conventional window.

SUMMARY OF THE INVENTION

In view of the foregoing disadvantages inherent in the known types of Security Devices now present in the prior art, the present invention provides a new Adjustable Telescopic Window Security System construction wherein the same can be utilized for facilitating increased security for various sizes of conventional windows while allowing the user to simultaneously adjust the position of the window so as to allow ventilation through the conventional window.

The general purpose of the present invention, which will be described subsequently in greater detail, is to provide a new Adjustable Telescopic Window Security System apparatus and method which has many of the advantages of the Security Devices mentioned heretofore and many novel features that result in a new Adjustable Telescopic Window Security System which is not anticipated, rendered obvious, suggested, or even implied by any of the prior art Security Devices, either alone or in any combination thereof.

To attain this, the present invention generally comprises a telescopic security tube adjustable to various sizes of windows, at least one window engaging suction cup to retain the present invention to the conventional window, and a pair a pane engaging caps secured to opposite ends of the telescopic security tube engaging the conventional window pane.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new Adjustable Telescopic Window Security System apparatus and method which has many of the advantages of the Security Devices mentioned heretofore and many novel features that result in a new Adjustable Telescopic Window Security System which is not anticipated, rendered obvious, suggested, or even implied by any of the prior art Security Devices, either alone or in any combination thereof.

It is another object of the present invention to provide a new Adjustable Telescopic Window Security System which may be easily and efficiently manufactured and marketed.

It is a further object of the present invention to provide a new Adjustable Telescopic Window Security System which is of a durable and reliable construction.

An even further object of the present invention is to provide a new Adjustable Telescopic Window Security System which is susceptible of a low cost of manufacture with regard to both materials and labor, and which accordingly is then susceptible of low prices of sale to the consuming public, thereby making such Adjustable Telescopic Window Security System economically available to the buying public.

Still yet another object of the present invention is to provide a new Adjustable Telescopic Window Security System which provides in the apparatuses and methods of the prior art some of the advantages thereof, while simultaneously overcoming some of the disadvantages normally associated therewith.

Still another object of the present invention is to provide a new Adjustable Telescopic Window Security System for facilitating increased security for various sizes of conventional windows while allowing the user to simultaneously adjust the position of the window so as to allow ventilation through the conventional window.

Yet another object of the present invention is to provide a new Adjustable Telescopic Window Security System which includes a telescopic security tube adjustable to various sizes of windows, at least one window engaging suction cup to retain the present invention to the conventional window, and a pair a pane engaging caps secured to opposite ends of the telescopic security tube engaging the conventional window pane.

Still yet another object of the present invention is to provide a new Adjustable Telescopic Window Security System that allows ventilation of the user's window while providing maximum safety from criminals.

Even still another object of the present invention is to provide a new Adjustable Telescopic Window Security System that is lightweight, strong, and simple to use.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
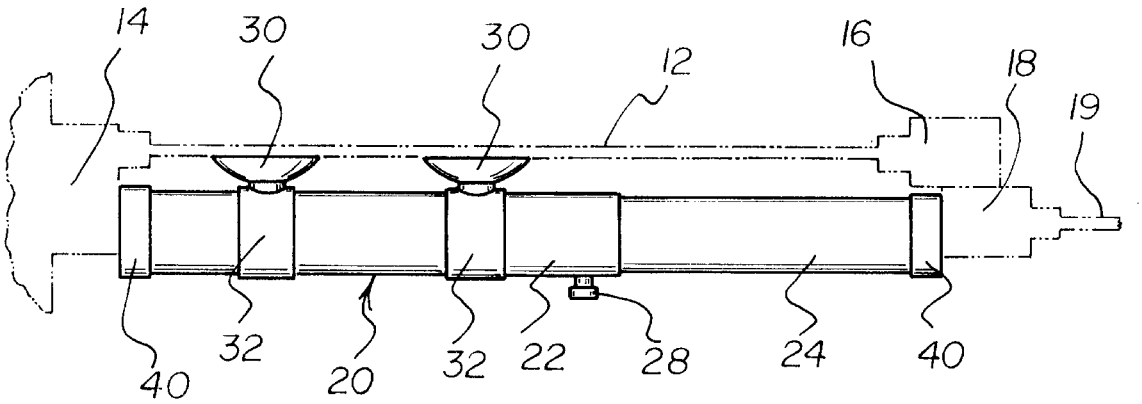
FIG. 1 is a side view of a new Adjustable Telescopic Window Security System engaging a conventional window according to the present invention.

With reference now to the drawings, and in particular to FIGS. 1 through 6 thereof, a new Adjustable Telescopic Window Security System embodying the principles and concepts of the present invention and generally designated by the reference numeral 10 will be described.

More specifically, it will be noted that the Adjustable Telescopic Window Security System 10 comprises a telescopic security tube 20, at least one window engaging suction cup 30 secured to the telescopic security tube 20 orthogonally to the longitudinal axis, and a pair of pane engaging cap 40 secured to the ends of the telescopic security tube 20.

Figure 2:
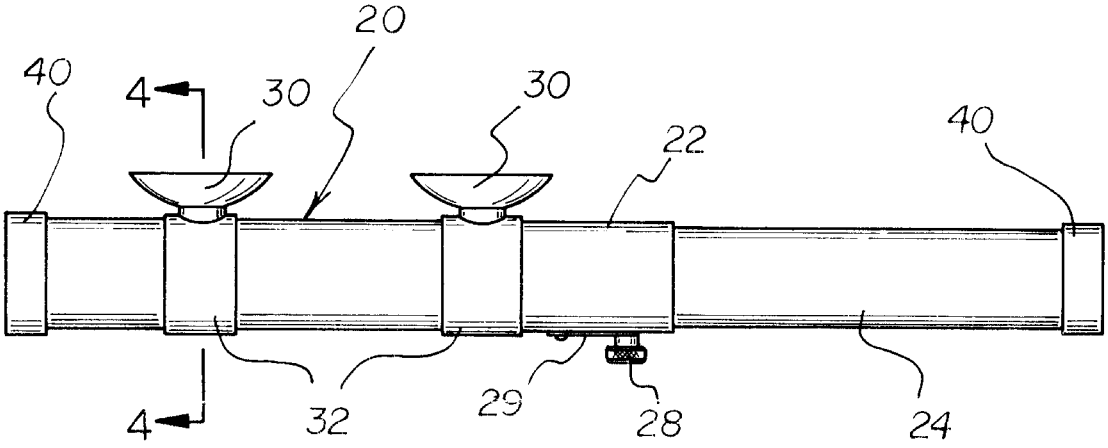
FIG. 2 is a side view thereof disclosing the second tube slidably positioned within the first tube.
Figure 3:
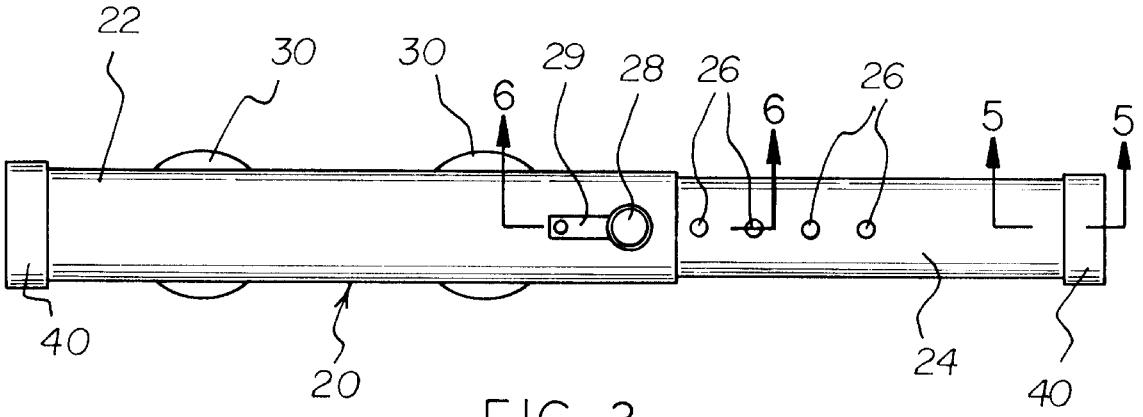
FIG. 3 is a top view disclosing the locking pin in cooperation with the locking aperture of the second tube.
Figure 4:
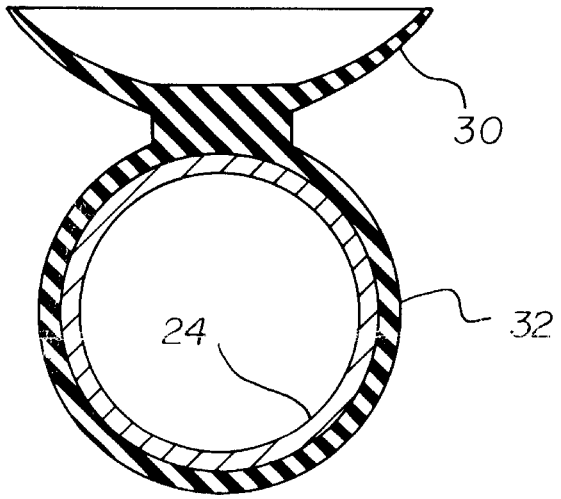
FIG. 4 is a cross sectional view taken along line 4—4 of FIG. 2 disclosing the engaging ring surrounding the first tube where the engaging ring secures the window engaging suction cup.
Figure 5:
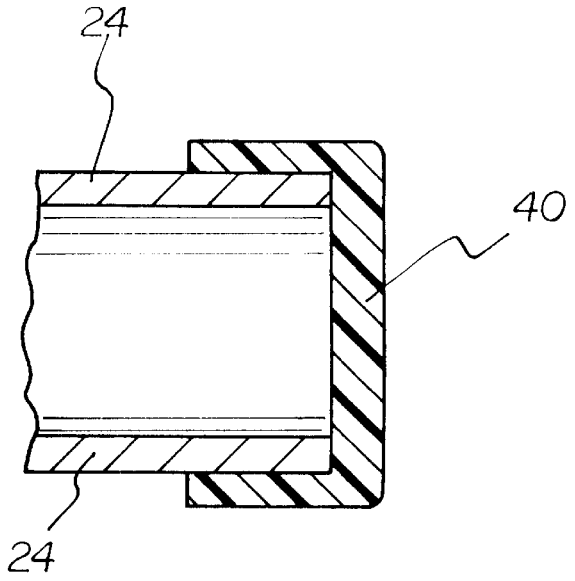
FIG. 5 is a cross sectional view taken along line 5—5 of FIG. 3 disclosing a pane engaging cap secured to the end of the second tube opposite of the first tube.
Figure 6:
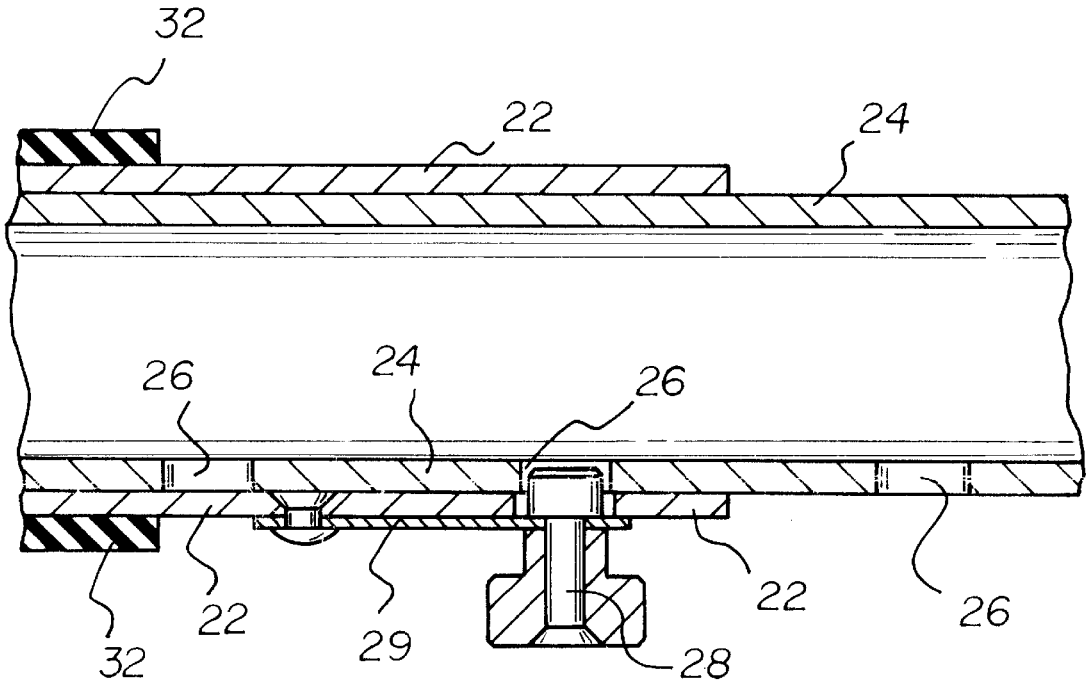
FIG. 6 is a cross sectional view taken along line 6—6 of FIG. 3 further disclosing the second tube slidably in cooperation with the first tube, and the locking pin projecting through the locking aperture.

As best illustrated in FIGS. 1 through 6, it can be shown that the telescopic security tube 20 includes a first tube 22 securing the window engaging suction cup 30*s* with the pane engaging cap 40 secured at one end. A second tube 24 is slidably projecting within the first tube 22 opposite of the pane engaging cap 40 secured to the first tube 22. The second engaging cap is secured at the end opposite of the first tube 22. The second tube 24 includes a plurality of locking aperture 26 aligned on one side in a horizontal line as best disclosed in FIG. 3 of the drawings. A flat spring 29 engages the first tube 22 at one end near the end opposite of the pane engaging cap 40 as best disclosed in FIG. 6 of the drawings. A locking pin 28 is secured orthogonally to the end of the flat spring 29 opposite of the first tube 22 removably projecting through the first tube 22 into the locking aperture 26 of the second tube 24. An engaging ring 32 is secured to the exterior circumference of the first tube 22 orthogonally securing the window engaging suction cup 30. There are preferably two window engaging suction cups 30 distally spaced and secured to the first tube 22 by two engaging rings 32 as shown in FIG. 2 of the drawings. The first tube 22 preferably has a one inch diameter with a 0.030 inch thickness wall and is constructed from a lightweight material such as aluminum. Preferably, the second tube 24 has a ⅞ inch diameter with a 0.060 inch thickness wall and is constructed from a lightweight material such as aluminum. The window engaging suction cups 30 preferably have a two inch diameter providing maximum vacuum force in relation to weight.

In use, the user secures the window engaging suction cups 30 to a stationary glass window 12. The user then retracts the locking pin 28 allow manual manipulation of the second tube 24 in relation to the first tube 22 to the desired length allowing a sliding glass window 19 to have the desired position while having the security of a closed window. The user then releases the locking pin 28 where the locking pin 28 thereby projects into a locking aperture 26 within the second tube 24 retaining the chosen position in relation to the first tube 22. The end of the second tube 24 opposite of the first tube 22 engages a third window pane 18 which surrounds the sliding glass window 19, thereby preventing movement of the sliding glass window 19 past that position. The end of the first tube 22 opposite of the second tube 24 preferably engages a first window pane 14 surrounding the stationary glass window 12. If the sliding glass window 19 is closed, the present invention will retain its position from the window engaging suction cups 30 thereby prepared for the user to open the sliding glass window 19 or stop a criminal from opening the sliding glass window 19 past the chosen position.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An adjustable telescopic window security system for use with a window assembly having at least two window sashes, each said window sash comprising a window sash perimeter frame surrounding a glass pane, said window sashes being mounted in a window frame in a manner permitting slidable movement of said sashes along parallel adjacent paths, said system comprising:

an elongate telescopic tube having opposite ends, said telescopic tube having an adjustable length between said opposite ends, said telescopic tube comprising an elongate first tube portion and a second tube portion, one said tube portion being telescopically received in the interior of the other said tube portion;

at least one window engaging suction cup mounted on one of said tube portions in an orientation substantially orthogonal to the longitudinal axis of said tube portion for securing the telescopic tube in a substantially parallel relationship to the class pane of a window, said suction cup being adapted to support said telescopic tube in an adjacent relationship to one of said window sashes and in the slidable movement path of the other said window sash; and a pair of engaging caps, each said engaging cap being secured to an end of a tube portion such that said telescopic tube may be positioned with one of said engaging caps engaging a window sash frame and the other of said engaging caps engaging a window frame to restrict the movement of said window sash relative to said window frame.

2. The adjustable telescopic window security system of claim 1 wherein said first tube portion is substantially hollow and said second tube portion is received in said first tube portion;

the second tube portion including a plurality of locking apertures generally arranged in a line substantially parallel to the length of said second tube portion; and a locking pin secured to the first tube portion and projecting through a hole in the first tube portion and removably projecting into one of said locking apertures of the second tube portion to releasably lock the longitudinal position of said second tube portion with respect to said first tube portion and thereby adjust the length of the telescopic tube to approximate the distance between one of said window sash perimeter frames and the window frame.

3. The adjustable telescopic window security system of claim 1 additionally comprising an engaging ring secured to the exterior circumference of the first tube portion, said window engaging suction cup being secured to said engaging ring in a substantially orthogonal orientation to the longitudinal axis of said first tube portion.

4. The adjustable telescopic window security system of claim 3 additionally comprising a second window engaging suction cup secured to the exterior of said first tube portion in a substantially orthogonal orientation to the longitudinal axis of said first tube portion.

5. The adjustable telescopic window security system of claim 1 wherein the first tube portion has about a one inch diameter with about a 0.030 inch thickness wall constructed from a lightweight material.

6. The adjustable telescopic window security system of claim 1 wherein the second tube portion has about a ⅞ inch diameter with about a 0.060 inch thickness wall constructed from a lightweight material.

7. The adjustable telescopic window security system of claim 1 wherein the window engaging suction cup has approximately a two inch diameter.

8. An adjustable telescopic window security system for use with a window assembly having at least two window sashes, each said window sash comprising a window sash perimeter frame surrounding a glass pane, said window sashes being mounted in a window frame in a manner permitting slidable movement of said sashes along parallel adjacent paths, said system comprising:

an elongate telescopic tube having opposite ends, said telescopic tube having an adjustable length between said opposite ends, said telescopic tube comprising an elongate first tube portion and a second tube portion, one said tube portion being telescopically received in the interior of the other said tube portion, wherein said first tube portion is substantially hollow and said second tube portion is received in said first tube portion, the second tube portion including a plurality of locking apertures generally arranged in a line substantially parallel to the length of said second tube portion;

at least one window engaging suction cup mounted on one of said tube portions in an orientation substantially orthogonal to the longitudinal axis of said tube portion for securing the telescopic tube in a substantially parallel relationship to the glass pane of a window, said suction cup being adapted to support said telescopic tube in an adjacent relationship to one of said window sashes and in the slidable movement path of the other said window sash;

a pair of engaging caps, each said engaging cap being secured to an end of a tube portion such that said telescopic tube may be positioned with one of said engaging caps engaging a window sash frame and the other of said engaging caps engaging a window frame to restrict the movement of said window sash relative to said window frame;

a locking pin secured to the first tube portion and projecting through a hole in the first tube portion and removably projecting into one of said locking apertures of the second tube portion to releasably lock the longitudinal position of said second tube portion with respect to said first tube portion and thereby adjust the length of the telescopic tube to approximate the distance between one of said window sash perimeter frames and the window frame;

an engaging ring secured to the exterior circumference of the first tube portion, said window engaging suction cup being secured to said engaging ring in a substantially orthogonal orientation to the longitudinal axis of said first tube portion; and a second window engaging suction cup secured to the exterior of said first tube portion in a substantially orthogonal orientation to the longitudinal axis of said first tube portion.

9. The adjustable telescopic window security system of claim 8 wherein the first tube portion has about a one inch diameter with about a 0.030 inch thickness wall constructed from a lightweight material, wherein the second tube portion has about a ⅞ inch diameter with about a 0.060 inch thickness wall constructed from a lightweight material, and wherein the window engaging suction cup has approximately a two inch diameter.

10. The adjustable telescopic window security system of claim 2 additionally comprising a spring mounted on said first tube portion with said locking pin being mounted on said spring in a manner so as to bias said locking pin into the hole in said first tube portion and the locking apertures of said second tube portion.

* * * * *